United States Patent [19]

Tams, III

[11] 4,191,295

[45] Mar. 4, 1980

[54] PROCESSING RACK

[75] Inventor: Frederick J. Tams, III, Trenton, N.J.

[73] Assignee: RCA Corporation, New York, N.Y.

[21] Appl. No.: 933,871

[22] Filed: Aug. 14, 1978

[51] Int. Cl.[2] ..... A47F 7/00

[52] U.S. Cl. ..... 211/41; 206/454; 269/297

[58] Field of Search ..... 211/41; 206/454, 564; 118/500; 269/321 WE, 296, 297, 265, 266; 432/239

[56] References Cited

U.S. PATENT DOCUMENTS

| | | | |
|---|---|---|---|
| 866,860 | 9/1907 | Herrmann | 211/84 |
| 1,971,523 | 8/1934 | Feingold | 211/41 |
| 2,443,404 | 6/1948 | Tallarico | 211/41 |
| 3,486,631 | 12/1969 | Rodman | 211/41 |
| 3,682,083 | 8/1972 | Puente | 206/454 X |
| 3,889,815 | 6/1975 | Merle | 211/41 |
| 3,941,273 | 3/1976 | Dalencon | 211/41 |

FOREIGN PATENT DOCUMENTS

| | | | |
|---|---|---|---|
| 174267 | 1/1922 | United Kingdom | 211/41 |

*Primary Examiner*—Roy D. Frazier
*Assistant Examiner*—Robert W. Gibson, Jr.
*Attorney, Agent, or Firm*—Samuel Cohen; William Squire

[57] ABSTRACT

A universal self-aligning rack for carrying and holding substrates of different sizes and shapes during the processing of the substrates. The rack includes first and second spaced substrate supports which are pivotal about parallel axes. Each support includes a pair of spaced elongated elements parallel to the axes, formed with tapered circumferential grooves oriented perpendicularly to the axes. The substrates to be supported are arranged parallel to cne another in planes perpendicular to the axes and are supported at their edges in the grooves in respective elongated elements, which elements pivot to appropriate supporting positions in response to the placement of the substrates in the rack.

10 Claims, 10 Drawing Figures

PROCESSING RACK

Figure 1:
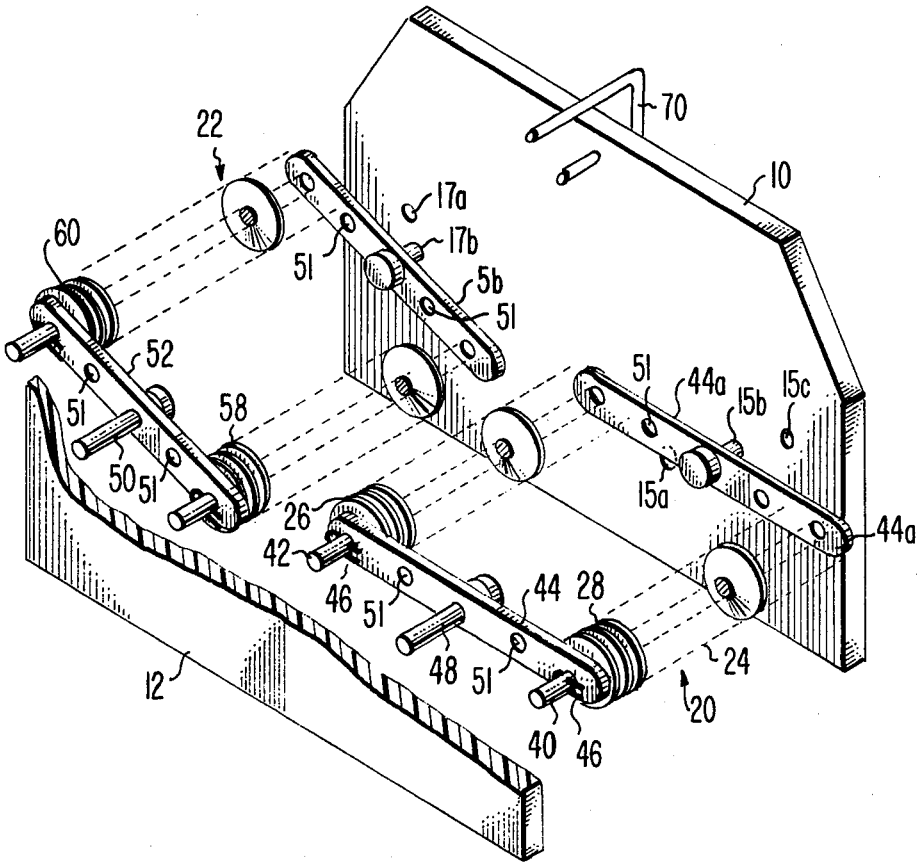

When a corrosive cleansing agent is employed in the processing of substrates it should flow around the substrates quickly and efficiently and should then fairly thoroughly drain away from the substrates. During such processing, the substrates are held in a rack which is specifically designed for a particular substrate size and shape. If it is desired to process substrates having a wide variety of sizes and shapes, a correspondingly wide variety of racks must be purchased and stored, which is costly and inefficient.

A rack embodying the present invention can accommodate substrates of a wide variety of shapes and of many different sizes. The rack includes first and second supports mounted for rotation about respective spaced parallel axes, each support comprising a pair of spaced parallel members. Each support can rotate independently of the other support. An article placed against the supports rotates the supports until they contact the article in an article supporting configuration.

Figure 2:
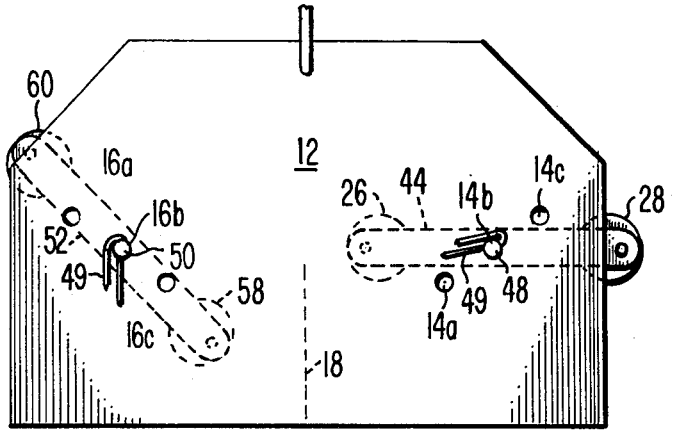
Figure 3:
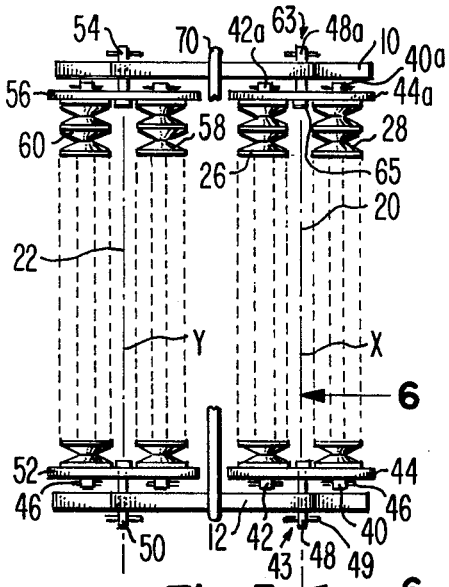
Figure 4:
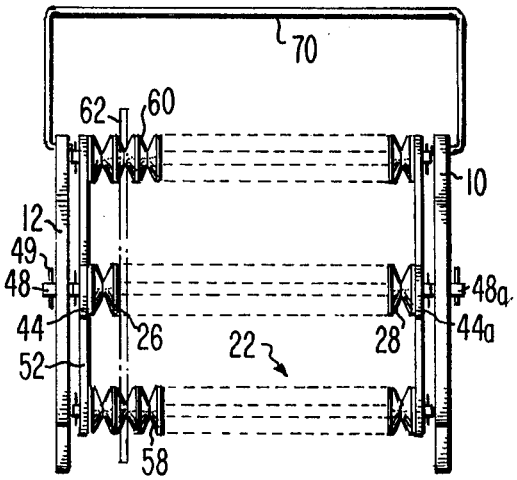
Figure 5A:
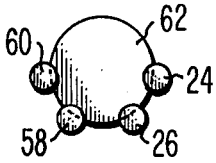
Figure 5B:
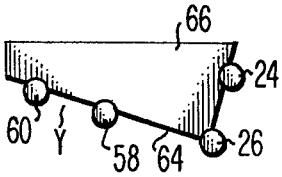
Figure 5C:
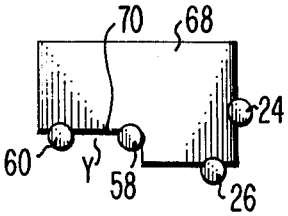
Figure 6:
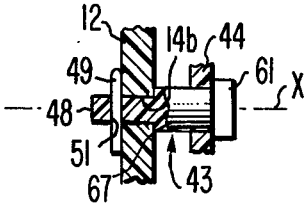
Figure 7:
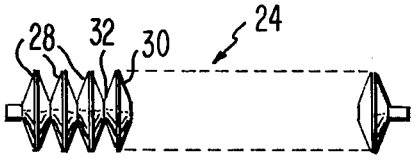
Figure 8:
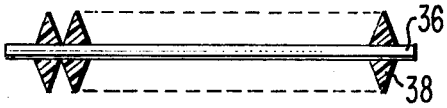

In the drawing:

FIG. 1 is a perspective fragmentary view of a rack in accordance with an embodiment of the present invention, FIG. 2 is an end elevational view of the rack of FIG. 1, FIG. 3 is a plan view of the rack of FIG. 1, FIG. 4 is a side elevational view of the same rack, FIGS. 5A and 5B and 5C illustrate different shaped substrates which may be used with the rack of FIG. 1, FIG. 6 is a sectional view taken along lines 6—6 of FIG. 3, FIG. 7 is a side view illustrating one of the support rods of FIG. 1, and FIG. 8 illustrates an alternative embodiment for the support rods of FIG. 1.

The processing rack shown in FIGS. 1, 2, 3 and 4 has plane parallel identical end plates 10 and 12 made of inert sheet material such as a polytetrafluorethylene, (Teflon). Plate 12 has three axially aligned support bearing apertures 14*a*, 14*b* and 14*c* which are positioned along a line that is at an angle of approximately +45° to the vertical. A second set of aligned support bearing apertures 16*a*, 16*b* and 16*c* formed in plate 12 and at an angle of −45° with the vertical. With respect to an imaginary vertical dividing line 18, shown dashed in FIG. 2, the apertures 14*a*, 14*b* and 14*c* are mirror images of the apertures 16*a*, 16*b* and 16*c* in position and orientation. Apertures 15*a*, *b*, *c* and 17*a*, *b* and *c* in plate 10 are of the same size as and in the same positions as the corresponding apertures 14*a*, *b*, *c* and 16*a*, *b* and *c* respectively in plate 12. If lines were drawn connecting aperture pair 14*a* and 15*a*, aperture pair 14*b* with 15*b*, and so forth, these lines would be parallel.

Substrate support 20 is identical to substrate support 22 and both are mounted between plates 10 and 12 as will be described. Support 20 includes two inert thermoplastic elements 24 and 26, preferably formed of Teflon. These are one piece structures which may be turned, cast or otherwise formed into a plurality of discs 28 joined to one another by a central solid core as shown in FIG. 7.

Alternatively, elements such as 24 may be formed by assembly of individual discs, each with a central aperture, on a shaft 38, such as one formed of Teflon, as shown in FIG. 8. The discs in either case have tapered surfaces and each pair of adjacent surfaces 30 form a V-shaped annular groove 32 (FIG. 7). All of the elements in supports 20 and 22 may be identical to element 24. In other implementations, the elements in supports 20 and 22 need not always be identical. This depends on the configuration of the substrate material to be supported in the rack.

Shafts 40 and 40*a* extend from opposite ends of element 24 and shafts 42 and 42*a* extend from opposite ends of element 26. Link 44 connects shafts 40 and 42 and link 44*a* connects shafts 40*a* and 42*a*. The connecting links 44 and 44*a* preferably are made out of the same inert thermoplastic material as the rest of the structure. Inert implies that there is no chemical reaction between the rack material and the processing chemicals. Retaining pins 46 are inserted in holes at the ends of the respective shafts to lock the links to the shafts to form rectangular frame members.

The support 20 is mounted to plate 12 via bearing 43, the details of which are shown in FIG. 6, and to plate 10 via a similar bearing 63. Bearing 43 has a bearing shaft 48 and an end cap 61. Shaft 48 has a bearing shoulder 67 in abutment with plate 12 FIG. 6. Shoulder 67 spaces support 20 from plate 12 and prevents contact therebetween. Bearing 63 has a bearing shaft 48*a*, a shoulder similar to shoulder 67, and an end cap 65. As shown in FIG. 6, shaft 48 passes through journal aperture 14*b* in plate 12, and is locked in place by pin 49 in hole 51 in shaft 48. Cap 61 is fixed to the inner end of shaft 48 and its function is to hold the link 44 in position on shaft 48, the link being rotatable about shaft 48. Bearing 63 is secured to plate 10 similarly. The bearing 50 and 54 mounting support 22 to plates 12 and 10 respectively, are constructed in identical fashion to bearing 43, and from the same inert thermoplastic material. Shaft 48 passes through one of the apertures 14*a*, 14*b* and 14*c*, for example 14*b*, and shaft 48*a* passes through its paired aperture 15*b*, in this example, in the plate 10.

It will be appreciated that the length of links 44 and 44*a* of support 20, in certain implementations, may be different than the length of the links 52 and 56 of support 22. The shaft of bearing 50 mounted to link 52 of support 22 passes through one of the apertures 16*a*, *b* or *c* plate 12. The shaft of bearing 54 mounted to link 56 at the opposite end of support 22 passes through the paired aperture in plate 10 so that support 22 can rotate about axis Y parallel to the X axis. The elements of support 20 may be equally or unequally spaced from the X axis and the elements of support 22 may be similarly spaced from the Y axis. As shown, they are equally spaced. The supports 20 and 22 are rotatable about the X and Y axes, respectively; however, there is sufficient friction in the bearings that the frames, after being manually rotated to the desired angular positions, remain in these positions. A plurality of spaced journals 51 can be formed in links 44, 44*a*, 52 and 56 to provide other adjustable positions for the bearings 43, 63, 50 and 54.

FIGS. 5A, 5B and 5C show how substrates of different sizes and shapes may be supported by the processing rack just described. In FIG. 5A a large circular disc-shaped substrate 62, shown in phanton in FIG. 4, is shown mounted in the rack. It has a thickness which is smaller than the maximum spacing between the surfaces defining a groove 32 between a pair of adjacent discs 28, and while this is generally the case for any substrate it is desired to support in the rack, it is not essential. The grooves secure the substrates in the lateral directions along the X axis so that the substrate being held is wedged in place. Other supports interchangeable with support 20 and 22, may have grooves different than that shown. FIG. 5b shows an odd shaped member. For this member, the elements 58 and 60 support 22 pivot about the Y axis an amount sufficient to receive the edge 64 of the substrate 66. In FIG. 5C the substrate 68 is of a different shape. The rods 58 and 60 pivot about the Y axis an amount sufficient to receive edge 70. The substrates are inserted by hand and the supports 20 and 22 readily assume the position required to secure the substrates. A wire handle 20 may be connected to plates 10 and 12 for carrying the rack.

Should the size, i.e., area, of the substrate vary significantly, then the supports 20 and 22 can be removed from the end plates 10 and 12 and the shafts of the support links reinserted in the desired ones of the apertures 14*a, b* and *c* and 16*a, b* and *c*. Also, the shaft 48 of the support 20 may be inserted into the aperture 14*c*, while the shaft of bearing 50 support 22 may be inserted in aperture 16*c* to adjust the support spacing in accordance with a given substrate shape. As a result, flexibility and universality, is provided, in a rack with an extremely simple construction. A substrate cleaning fluid or other processing liquid flows freely around the substrate material, does not accumulate, and drains efficiently and quickly.

In general, the rack described is employed to hold a plurality of substrates of the same size and shape at one time, for processing. These are supported in the rack parallel to each other in adjacent grooves formed by the discs 28. These substrates, in the general case, will be relatively thin, planar members. However, it is to be understood that the rack may alternatively be employed to support individual elements.

What is claimed is:

1. A rack comprising:

a frame;

first and second pairs of members for receiving and supporting an article which may have any one of many different shapes and sizes, each said member having a long axis;

first support means mounting the two members of said first pair with their long axes in fixed, parallel spaced relationship;

second support means mounting the two members of said second pair with their long axes in fixed, parallel spaced relationship; and means rotatably mounting said first and said second support means to said frame so that said first pair of members is rotatable in either direction about a first axis which is parallel to and spaced from the axes of said first pair of members, and said second pair of members is rotatable in either direction about a second axis which is parallel to and spaced from said first axis and the axes of said members of said second pair, whereby when an article is placed into said rack in a position such that it bears against at least one member of each pair, it tends to cause the members of each pair to rotate about the first and second axes until they assume orientations abutting the article in which the article is stably supported.

2. The rack of claim 1 wherein each member includes a plurality of circumferential grooves around the long axis of that member, each groove bing adapted to receive an edge portion of an article, the grooves in each member being aligned with corresponding grooves in the other members.

3. The rack of claim 1 wherein the frame includes first and second parallel walls, said members being mounted between said walls with their axes normal to the walls.

4. The rack of claim 1 wherein each member comprises a plurality of side-by-side discs, each disk being relatively thick at its center and tapering to a relatively thin dimension at its circumferential edge.

5. The rack of claim 1 wherein the axes of said first pair of members and said first axis lie in a first imaginary plane and the axes of said second pair of members and said second axis lie in a second imaginary plane, said first plane being rotatable about said first axis, and said second plane being rotatable about said second axis.

6. The rack of claim 1 wherein said means for rotatably mounting includes means for permitting adjustment of the spacing between said first and second axes.

7. A universal processing rack for supporting a plurality of articles comprising:

a first article support including first and second spaced parallel elements, a second article support including third and fourth spaced parallel elements, and means for rotatably mounting the first and second supports about respective parallel first and second axes, the first axis being parallel to and between said first and second elements, the second axis being parallel to and between said third and fourth elements, said means for rotatably mounting being adapted to permit said first support to rotate about its axis in either of two directions independently of the direction of rotation of said second support in response to said article being placed in contact with each said elements.

8. The rack of claim 7 wherein said means for rotatably mounting includes first and second end walls, said first and second supports being mounted between said end walls.

9. In combination:

a pair of spaced wall members, four elongated elements each comprising a plurality of annular grooves, four link members, one link member joining one of the ends of one pair of elements in fixed spaced relation and another member joining the other ends of the one pair of elements in fixed parallel spaced relation to form a first support, third and fourth link members joining opposite ends of a second different pair of elements in fixed spaced parallel relation to form a second support, a first pair of bearings joining said first support along a first axis of rotation to said spaced wall members, one bearing of the pair in a different wall member, a second pair of bearings joining said second support along a second axis of rotation parallel to and spaced from said first axis to said spaced wall members, each said axis being spaced from the elements of its corresponding support.

10. The combination of claim 9, wherein said wall and link members each have a plurality of spaced bearing journals for setting the spaced relationship of the elements in said supports and the spaced relationship of said supports to different parallel settings.

* * * * *